US009887451B2

(12) United States Patent
Lin

(10) Patent No.: US 9,887,451 B2
(45) Date of Patent: Feb. 6, 2018

(54) ANTENNA STRUCTURE AND WIRELESS COMMUNICATION DEVICE USING SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 475 days.

(21) Appl. No.: 14/481,292

(22) Filed: Sep. 9, 2014

(65) Prior Publication Data

US 2015/0109171 A1 Apr. 23, 2015

(30) Foreign Application Priority Data

Oct. 18, 2013 (CN) ..... 2013 1 04879973

(51) Int. Cl.

| | |
|---|---|
| ***H01Q 1/24*** | (2006.01) |
| ***H01Q 7/00*** | (2006.01) |
| ***H01Q 9/26*** | (2006.01) |
| ***H01Q 5/371*** | (2015.01) |

(52) U.S. Cl.

CPC ..... *H01Q 1/243* (2013.01); *H01Q 5/371* (2015.01); *H01Q 7/00* (2013.01); *H01Q 9/26* (2013.01)

(58) Field of Classification Search

CPC ..... H01Q 1/243; H01Q 5/371; H01Q 7/00; H01Q 9/26

USPC ..... 343/702

See application file for complete search history.

(56) References Cited

U.S. PATENT DOCUMENTS

| | | | | |
|---|---|---|---|---|
| 6,081,242 | A * | 6/2000 | Wingo | H01Q 1/242 333/32 |
| 7,358,906 | B2 * | 4/2008 | Sato | H01Q 1/243 343/700 MS |
| 7,505,006 | B2 * | 3/2009 | Ollikainen | H01Q 1/243 343/702 |
| 7,688,275 | B2 * | 3/2010 | Montgomery | H01Q 1/243 343/820 |
| 7,834,811 | B2 * | 11/2010 | Chen | H01Q 1/2291 343/702 |
| 8,040,284 | B2 * | 10/2011 | Teng | H01Q 1/245 343/700 MS |
| 2007/0008227 | A1 * | 1/2007 | Napoles | H01Q 1/243 343/702 |
| 2009/0051620 | A1 * | 2/2009 | Ishibashi | H01Q 1/243 343/897 |
| 2010/0087235 | A1 * | 4/2010 | Chiang | H01Q 7/00 455/575.7 |

(Continued)

*Primary Examiner* — Jessica Han
*Assistant Examiner* — Bamidele A Jegede
(74) *Attorney, Agent, or Firm* — ScienBiziP, P.C.

(57) ABSTRACT

An antenna structure includes a radiator, a first metallic sheet, and a second metallic sheet. The first metallic sheet and the second metallic are positioned at two opposite sides of the radiator. The radiator includes a first radiator portion, a second radiator portion, a third radiator portion. The second radiator portion and the third radiator portion are symmetrically connected to the first radiator portion. The first radiator portion is coupled to the second metallic sheet, both the second radiator portion and the third radiator portion are coupled to the first metallic sheet. The first metallic sheet, the second metallic sheet, and the radiator jointly form a loop structure.

19 Claims, 6 Drawing Sheets

(56) References Cited

U.S. PATENT DOCUMENTS

| | | | | |
|---|---|---|---|---|
| 2011/0001673 | A1* | 1/2011 | You | H01Q 1/243 343/702 |
| 2012/0001815 | A1* | 1/2012 | Wong | H01Q 1/243 343/749 |
| 2013/0093630 | A1* | 4/2013 | Hsu | H01Q 1/243 343/702 |
| 2013/0241781 | A1* | 9/2013 | Breiter | H01Q 5/35 343/702 |

* cited by examiner

ANTENNA STRUCTURE AND WIRELESS COMMUNICATION DEVICE USING SAME

FIELD

The disclosure generally relates to antenna structure and wireless communication device using same.

BACKGROUND

Long term evolution (LTE) antennas are used in wireless communication devices, such as mobile phones, for receiving and transmitting wireless signals at a plurality of bandwidths.

BRIEF DESCRIPTION OF THE DRAWINGS

Many aspects of the present disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
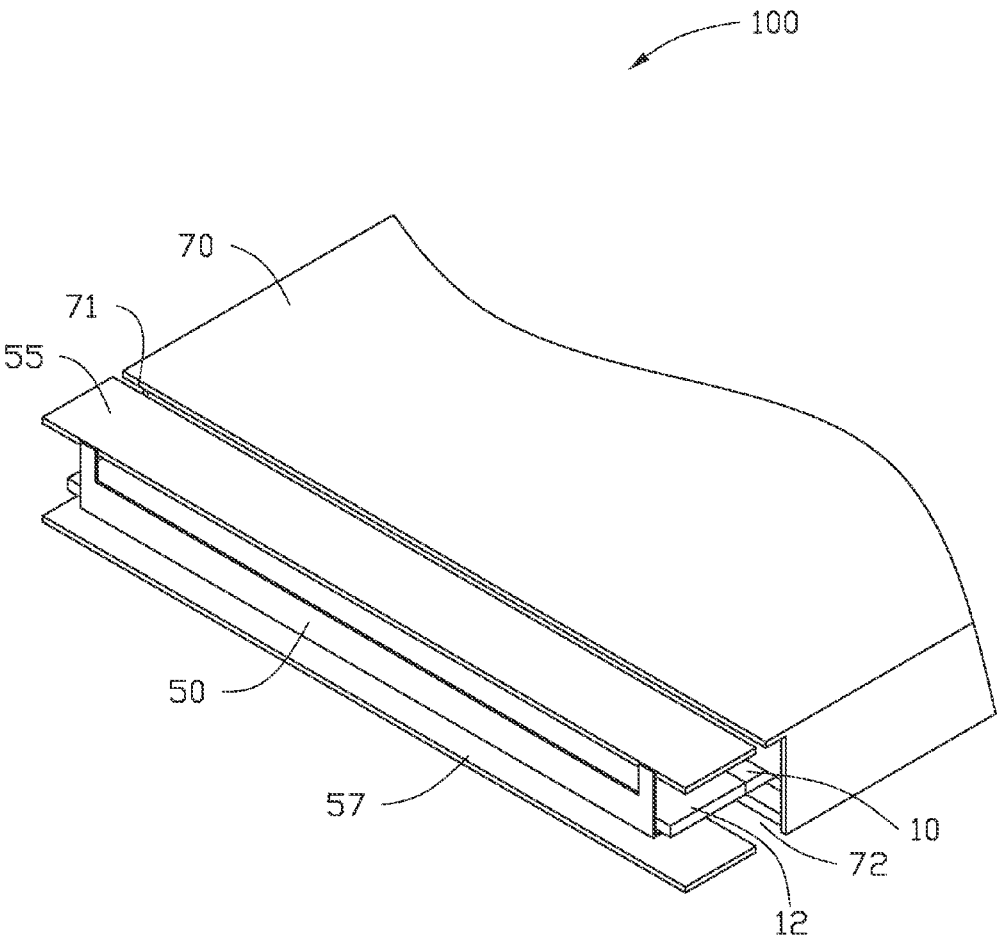
FIG. 1 is an isometric view of a wireless communication device, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a wireless communication device.

Figure 2:
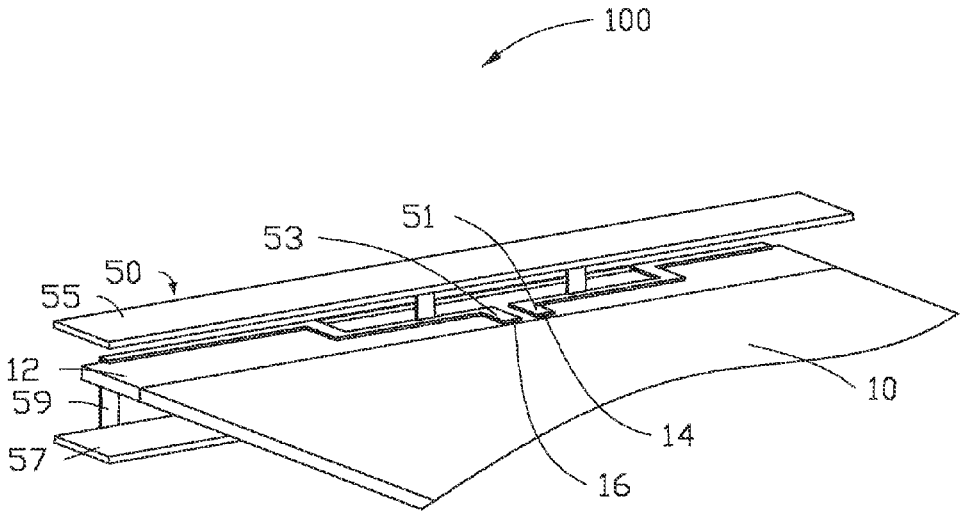
FIG. 2 is an isometric view of an antenna structure, according to an exemplary embodiment.

FIGS. 1-2 illustrate a wireless communication device 100 employing an antenna structure 50, according to an exemplary embodiment. The wireless communication device 100 can be a mobile phone or a tablet device, for example (details not shown).

The wireless communication device 100 includes a printed circuit board (PCB) 10. The PCB 10 is a substantially rectangular board having a keep-out-zone 12. The purpose of keep-out-zone 12 is to delineate an area on the PCB 10 in which other elements (such as a camera, a vibrator, a speaker, etc.) cannot be placed.

In the exemplary embodiment, the keep-out-zone 12 is located near an end of the PCB 10 and a housing 70. The PCB 10 further forms a feed pin 14 and a ground pin 16 in the keep-out-zone 12. The feed pin 14 provides current for the antenna structure 50, and the antenna structure 50 can be grounded by the ground pin 16.

The antenna structure 50 includes a feed end 51, a ground end 53, a first metallic sheet 55, a second metallic sheet 57, and a radiator 59. A first gap 71 is defined between the housing 70 and the first metallic sheet 55, and a second gap 72 is defined between the housing 70 and the second metallic sheet 57.

The feed end 51 is coupled to the feed pin 14. The ground end 53 is substantially parallel to the feed end 51, and is coupled to the ground pin 16. Both of the first metallic sheet 55 and the second metallic sheet 57 can be metal frames of the wireless communication device 100. In at least one embodiment, both the first metallic sheet 55 and the second metallic sheet 57 are rectangular sheets, and are positioned at two opposite sides of the keep-out-zone 12. The radiator 59 is coupled to the first metallic sheet 55 and the second metallic sheet 57 to form a loop structure.

Figure 3:
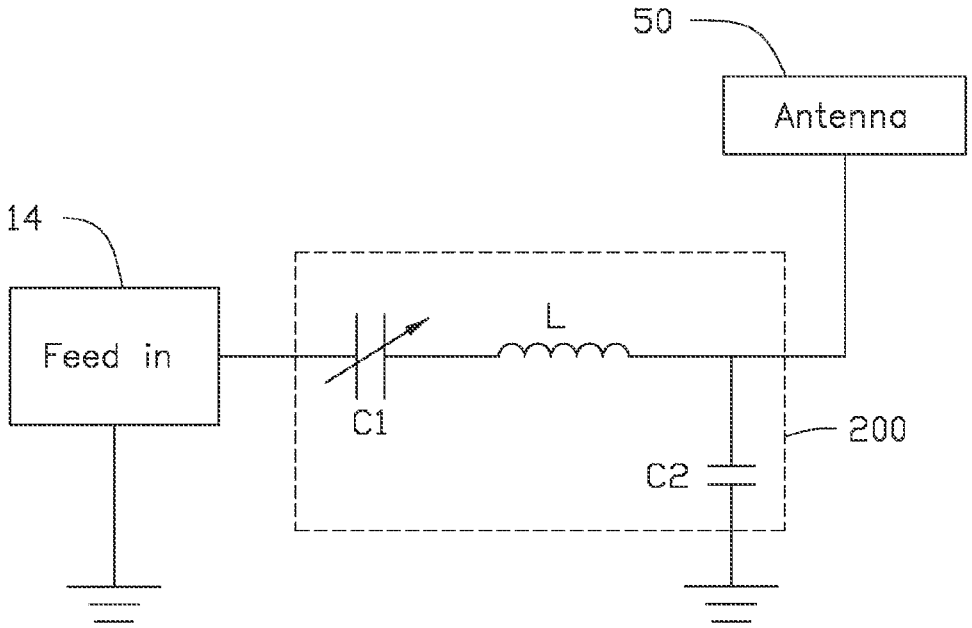
FIG. 3 is a circuit view of a matching circuit of the wireless communication device of FIG. 1.

FIG. 3 illustrates that the wireless communication device 100 further includes a matching circuit 200. The matching circuit 200 is configured to match an impedance of the antenna structure 50 for optimizing performance of the antenna structure 50 when the antenna structure 50 works in a low frequency mode. The matching circuit 200 is electronically coupled between the feed end 51 and the feed pin 14. In at least one embodiment, the matching circuit 200 includes a first capacitor C1, a second capacitor C2, and an inductor L. The first capacitor C1 and the inductor L are connected between the feed pin 14 and the antenna structure 50 in series. A first end of the second capacitor C2 is coupled between the inductor L and the antenna structure 50, and a second end of the second capacitor C2 is coupled to a ground. The first capacitor C1 can be an adjustable capacitor. In at least one embodiment, a capacitance value of the first capacitor C1 can be, for example, about 1.8 pF or 15 pF, a capacitance value of the second capacitor C2 can be, for example, about 1.3 pF, and an inductance value of the inductor L can be, for example, about 4.7 nH.

Figure 4:
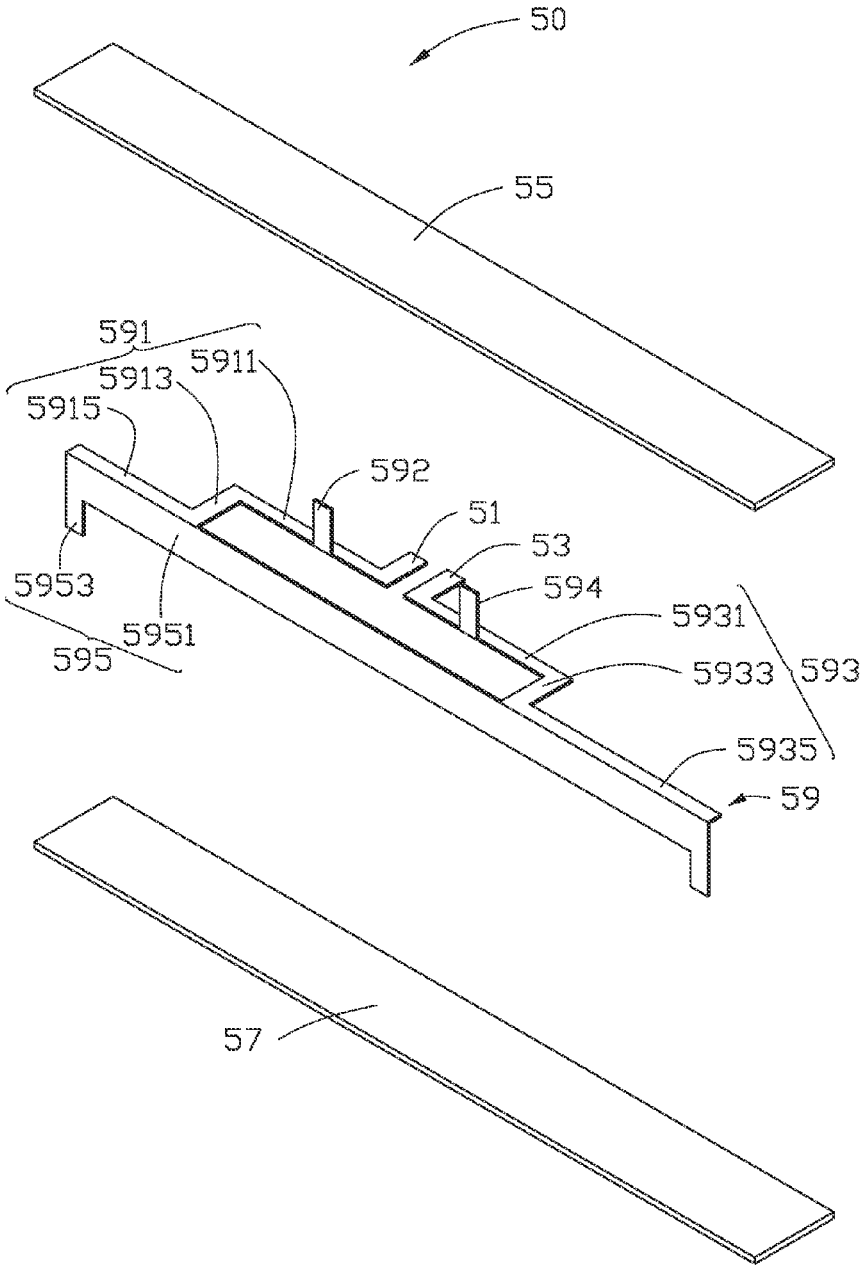
FIG. 4 is an exploded view of the antenna structure of FIG. 2.

FIG. 4 illustrates the radiator 59 including a first radiator portion 595, a second radiator portion 593, a third radiator portion 591, a first connection section 594, and a second connection section 592. A plane of the first radiator portion 595, the first connection section 594, and the second connection section 592 is substantially perpendicular to the PCB 10. A plane of the second radiator portion 593 and the third radiator portion 591 is substantially parallel to the PCB 10.

The first radiator portion 595 includes a main body 5951 and two distal ends 5953. The main body 5951 is a rectangular sheet. The two distal ends 5953 are positioned at two opposite sides of the first radiator portion 595, and are connected to two ends of the second metallic sheet 57, respectively.

The second radiator portion 593 and the third radiator portion 591 are substantially perpendicular to the first radiator portion 595, and are symmetrically positioned at a flange of the first radiator portion 595. The second radiator portion 593 is connected to the ground end 53, and includes a first extending section 5931, a second extending section 5933, and a third extending section 5935. The first extending section 5931 is substantially perpendicular to the ground end 53 and extends away from the feed end 51. The second extending section 5933 is perpendicularly connected between the first extending section 5931 and the third extending section 5935. The third extending section 5935 connects to a flange of the main body 5951, and extends along the main body 5951 until a distal end of the third extending section 5935 is aligned with a first distal end of the main body 5951. The third radiator portion 591 is connected to the feed end 51, and includes a first radiation section 5911, a second radiation section 5913, and a third radiation section 5915. The first radiation section 5911 is substantially perpendicular to the feed end 51 and extends away from the ground end 53. The second radiation section 5933 is perpendicularly connected between the first radiation section 5911 and the third radiation section 5915. The third radiation section 5915 connects to the flange of the main body 5951, and extends along the main body 5951 until a distal end of the third radiation section 5915 is aligned with a second distal end of the main body 5951.

The first connection section 594 is perpendicularly connected between the first extending section 5931 and the first metallic sheet 55. The second connection section 592 is perpendicularly connected between the first radiation section 5911 and the first metallic sheet 55.

When current is input to the feed pin 14, a first portion of the current flows to the matching circuit 200, the feed end 51, the third radiator portion 591, the first radiator portion 595, the second metallic sheet 57, the second radiator portion 593, the first gap 71, and the first metallic sheet 55 to form a first current path for resonating a first low frequency mode. A second portion of the current flows to the third radiator portion 591, the first radiator portion 595, the first gap 71, and the second radiator portion 593 to form a second current path for resonating a second low frequency mode. When the capacitance value of the first capacitor C1 is about 15 pF, a central frequency of the first low frequency mode can be, for example, about 800 MHZ, and a central frequency of the second low frequency mode can be, for example, about 925 MHZ. When the capacitance value of the first capacitor C1 is about 1.8 pF, a central frequency of the first low frequency mode can be, for example, about 700 MHZ, and a central frequency of the second low frequency mode can be, for example, about 850 MHZ.

Additionally, the second portion of the current can resonate a first high frequency mode and a second high frequency mode based on frequency doubling. A central frequency of the first high frequency mode can be, for example, about 1730 MHZ, and a central frequency of the second high frequency mode can be, for example, about 1910 MHZ. And then, a third portion of the current flows to the third radiator portion 591, the main body 5951, and the second radiator portion 593 to form a third current path for resonating a third high frequency mode. A central frequency of the third high frequency mode can be, for example, about 2200 MHZ. Moreover, a fourth portion of the current flows to the third radiator portion 591, the main body 5951, the second radiator portion 593, the first connection section 594, the second connection section 592, and the first metallic sheet 55 to form a fourth current path for resonating a fourth high frequency mode. A central frequency of the fourth high frequency mode can be, for example, about 2500 MHZ. Furthermore, a fifth portion of the current flows to the first connection section, the second connection section, and the first metallic sheet 55 to form a fifth current path for resonating a fifth high frequency mode. A central frequency of the fifth high frequency mode can be, for example, about 2630 MHZ.

Figure 5:
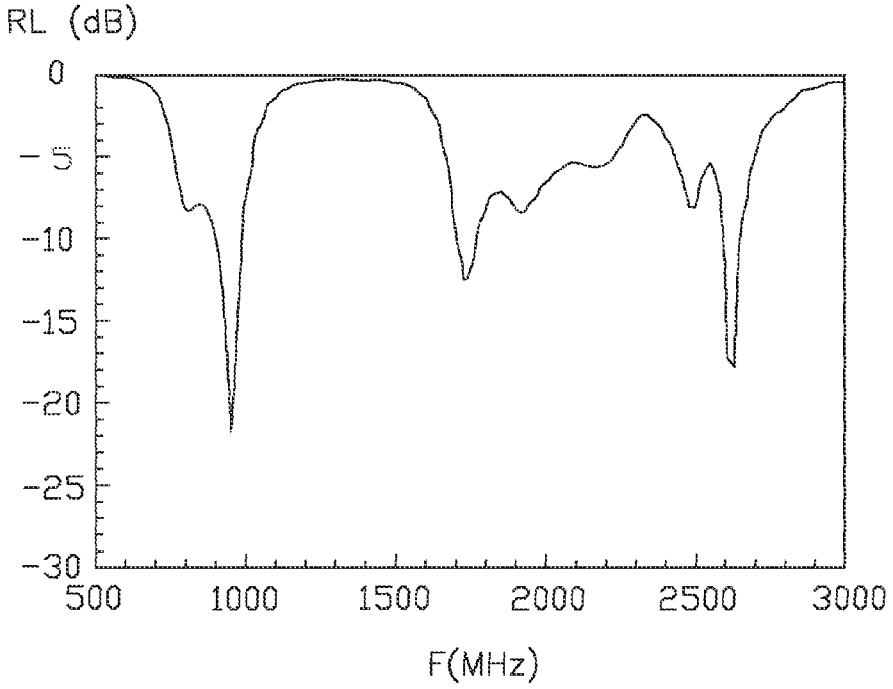
FIG. 5 is a first return loss (RL) graph of the antenna structure working in a low frequency mode and a high frequency mode.
Figure 6:
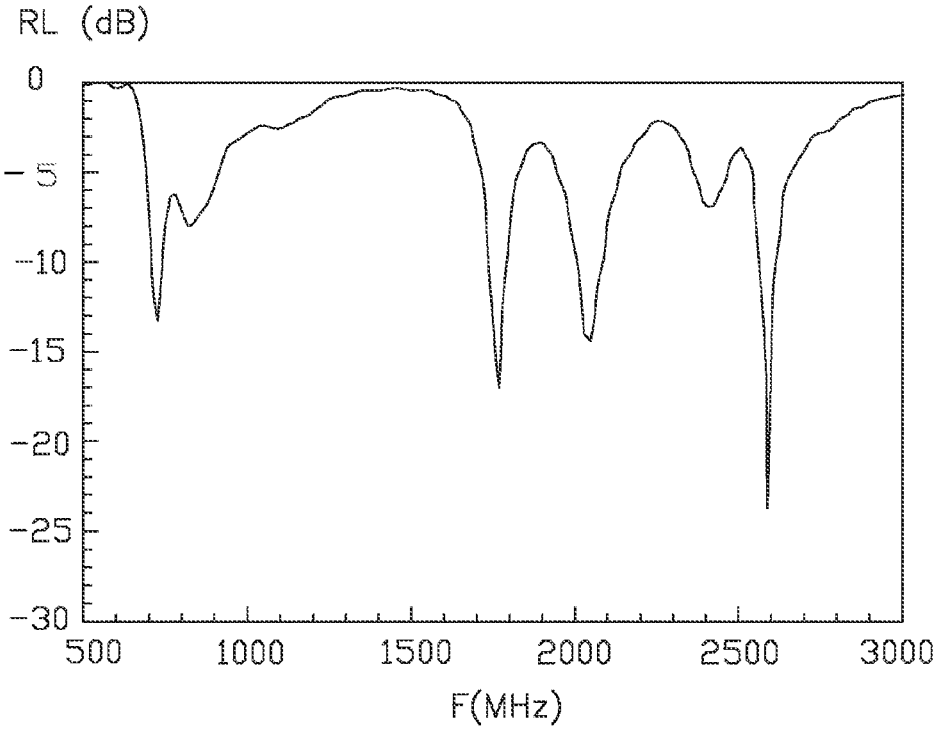
FIG. 6 is a second RL graph of the antenna structure working in a low frequency mode and a high frequency mode.

FIGS. 5-6 illustrate return loss (RL) graphs of the antenna structure 50 working in the first low frequency mode, the second low frequency mode, the first high frequency mode, the second high frequency mode, the third high frequency mode, the fourth high frequency mode, and the fifth high frequency mode. The wireless communication device 100 has good performance when operating at 750-960 MHZ, 700-900 MHZ, and 1710-2710 MHZ.

In summary, the radiator 59 is connected between the first metallic sheet 55 and the second metallic sheet 57 to allow the first metallic sheet 55 and the second metallic sheet 57 to be configured as a portion of the antenna structure 50. Thus, the wireless communication device 100 does not need any additional antennas, which can effectively utilize a space of the wireless communication device 100. In addition, a radiating capability of the antenna structure 50 of the wireless communication device 100 is effectively improved because of the matching circuit 200.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure comprising:

a radiator, the radiator comprising a first radiator portion, a second radiator portion, and a third radiator portion, the second radiator portion and the third radiator portion symmetrically connected to the first radiator portion, the first radiator portion comprising a main body;

a feed end coupled to the radiator;

a ground end coupled to the radiator;

a first metallic sheet, a first gap defined between a housing and the first metallic sheet;

a second metallic sheet, a second gap defined between the housing and the second metallic sheet;

a first connection section, the first connection section coupled between the second radiator portion and the first metallic sheet;

a second connection, the second connection section coupled between the third radiator portion and the first metallic sheet; and a matching circuit, the matching circuit comprising a first capacitor, a second capacitor, and an inductor, the first capacitor and the inductor connected between a feed pin and the feed end in series, a first end of the second capacitor coupled between the inductor and the feed end; and a second end of the second capacitor being grounded;

wherein the first metallic sheet and the second metallic sheet are positioned at two opposite sides of the radiator; the first radiator portion is coupled to the second metallic sheet; both the second radiator portion and the third radiator portion are coupled to the first metallic sheet; and the first metallic sheet, the second metallic sheet, and the radiator jointly form a loop structure; and wherein when current is input to the feed pin, a first portion of the current flows to the matching circuit, the feed end, the third radiator portion, the first radiator portion, the second metallic sheet, the second radiator portion, the first gap, and the first metallic sheet to form a first current path for resonating a first low frequency mode; a second portion of the current flows to the third radiator portion, the first radiator portion, the first gap, and the second radiator portion to form a second current path for resonating a second low frequency mode; the second portion of the current further resonates a first high frequency mode and a second high frequency mode based on frequency doubling; a third portion of the current flows to the third radiator portion, the main body, and the second radiator portion to form a third current path for resonating a third high frequency mode; a fourth portion of the current flows to the third radiator portion, the main body, the second radiator portion, the first connection section, the second connection section, and the first metallic sheet to form a fourth current path for resonating a fourth high frequency mode; and a fifth portion of the current flows to the first connection section, the second connection section, and the first metallic sheet to form a fifth current path for resonating a fifth high frequency mode.

2. The antenna structure as claimed in claim 1, wherein a plane of the second radiator portion and the third radiator portion is perpendicular to a plane of the first radiator portion, the second radiator portion and the third radiator portion are symmetrically connected to a flange of the first radiator portion.

3. The antenna structure as claimed in claim 1, wherein the first radiator portion further comprises two distal ends, the two distal ends are positioned at two opposite sides of the main body and connected to two ends of the second metallic sheet.

4. The antenna structure as claimed in claim 3, wherein the second radiator portion comprises a first extending section, a second extending section, and a third extending section; the first extending section is perpendicularly connected to the ground end and extends far away from the feed end; the second extending section is perpendicularly connected between the first extending section and the third extending section; and the third extending section connects to a flange of the main body and extends along the main body.

5. The antenna structure as claimed in claim 4, wherein the third radiator portion comprises a first radiation section, a second radiation section, and a third radiation section; the first radiation section is perpendicularly connected to the feed end and extends far away from the ground end the second radiation section is perpendicularly connected between the first radiation section and the third radiation section; and the third radiation section connects to the flange of the main body and extends along the main body.

6. The antenna structure as claimed in claim 5, wherein the first connection section is perpendicularly connected between the first extending section and the first metallic sheet.

7. The antenna structure as claimed in claim 5, wherein the second connection section is perpendicularly connected between the first radiation section and the first metallic sheet.

8. A wireless communication device comprising:

a printed circuit board (PCB), the PCB comprising a keep-out-zone, a feed pin, and a ground pin, the feed pin and the ground pin positioned in the keep-out-zone;

an antenna structure located at the PCB, the feed pin providing current for the antenna structure, and the antenna structure being grounded by the ground pin, the antenna structure comprising:

a radiator;

a feed end coupled to the radiator and the feed pin;

a ground end coupled to the radiator and the ground pin;

a first metallic sheet; and a second metallic sheet;

wherein the first metallic sheet and the second metallic sheet are positioned at two opposite sides of the radiator; the radiator comprises a first radiator portion, a second radiator portion, and a third radiator portion; the second radiator portion and the third radiator portion are symmetrically connected to the first radiator portion; the first radiator portion is coupled to the second metallic sheet; both the second radiator portion and the third radiator portion are coupled to the first metallic sheet; and the first metallic sheet, the second metallic sheet, and the radiator jointly form a loop structure.

9. The wireless communication device as claimed in claim 8, wherein a plane of the second radiator portion and the third radiator portion is perpendicular to a plane of the first radiator portion, the second radiator portion and the third radiator portion are symmetrically connected to a flange of the first radiator portion.

10. The wireless communication device as claimed in claim 8, wherein the first radiator portion comprises a main body and two distal ends, the two distal ends are positioned at two opposite sides of the first radiator portion and connected to two ends of the second metallic sheet.

11. The wireless communication device as claimed in claim 10, wherein the second radiator portion comprises a first extending section, a second extending section, and a third extending section; the first extending section is perpendicularly connected to the ground end and extends far away from the feed end the second extending section is perpendicularly connected between the first extending section and the third extending section; and the third extending section connects to a flange of the main body; and extends along the main body.

12. The wireless communication device as claimed in claim 11, wherein the third radiator portion comprises a first radiation section, a second radiation section, and a third radiation section; the first radiation section is perpendicularly connected to the feed end and extends far away from the ground end; the second radiation section is perpendicularly connected between the first radiation section and the third radiation section; and the third radiation section connects to the flange of the main body and extends along the main body.

13. The wireless communication device as claimed in claim 12, further comprising a first connection section, wherein the first connection section is perpendicularly connected between the first extending section and the first metallic sheet.

14. The wireless communication device as claimed in claim 12, further comprising a second connection, wherein the second connection section is perpendicularly connected between the first radiation section and the first metallic sheet.

15. The wireless communication device as claimed in claim 12, wherein both the first metallic sheet and the second metallic sheet are metal frames of the wireless communication device.

16. The wireless communication device as claimed in claim 15, further comprising a housing, a first gap is defined between the housing and the first metallic sheet, and a second gap is defined between the housing and the second metallic sheet.

17. The wireless communication device as claimed in claim 15, further comprising a matching circuit, wherein the matching circuit comprises a first capacitor, a second capacitor, and an inductor; the first capacitor and the inductor are connected between the PCB and the antenna structure in series; a first end of the second capacitor is coupled between the inductor and the antenna structure; and a second end of the second capacitor is grounded.

18. An Antenna structure, comprising:

a radiator having a first radiator portion, a second radiator portion, and a third radiator portion, with the second and third radiator portions symmetrically extending from the first radiator portion, the first radiator portion comprising a main body;

a feed end connected to the third radiator portion;

a ground end connected to the second end radiator portion;

a first metallic sheet connected to the first radiator portion and the second radiator portion, a first gap defined between a housing and the first metallic sheet; and a second metallic sheet connected to the first radiator portion, a second gap defined between the housing and the second metallic sheet;

a first connection section, the first connection section coupled between the second radiator portion and the first metallic sheet;

a second connection, the second connection section coupled between the third radiator portion and the first metallic sheet; and a matching circuit, the matching circuit comprising a first capacitor, a second capacitor, and an inductor, the first capacitor and the inductor connected between a feed pin and the feed end in series, a first end of the second capacitor coupled between the inductor and the feed end; and a second end of the second capacitor being grounded;

wherein, the first metallic sheet is substantially parallel to the second metallic sheet with the radiator positioned there between to form a U shaped loop; and wherein when current is input to the feed pin, a first portion of the current flows to the matching circuit, the feed end, the third radiator portion, the first radiator portion, the second metallic sheet, the second radiator portion, the first gap, and the first metallic sheet to form a first current path for resonating a first low frequency mode; a second portion of the current flows to the third radiator portion, the first radiator portion, the first gap, and the second radiator portion to form a second current path for resonating a second low frequency mode; the second portion of the current further resonates a first high frequency mode and a second high frequency mode based on frequency doubling; a third portion of the current flows to the third radiator portion, the main body, and the second radiator portion to form a third current path for resonating a third high frequency mode; a fourth portion of the current flows to the third radiator portion, the main body, the second radiator portion, the first connection section, the second connection section, and the first metallic sheet to form a fourth current path for resonating a fourth high frequency mode; and a fifth portion of the current flows to the first connection section, the second connection section, and the first metallic sheet to form a fifth current path for resonating a fifth high frequency mode.

19. The antenna structure of claim 18, wherein the second radiator portion and the third radiator portion are positioned substantially between the first metallic sheet and the second metallic sheet and a plane of the second radiator portion and third radiator portion is substantially perpendicular to a plane of the first radiator portion.

* * * * *